US009314067B2

(12) United States Patent
Bock

(10) Patent No.: US 9,314,067 B2
(45) Date of Patent: Apr. 19, 2016

(54) SHOE, IN PARTICULAR A SPORTS SHOE

(75) Inventor: Markus Bock, Herzogenaurach (DE)

(73) Assignee: PUMA SE, Herzogenaurach (DE)

( * ) Notice: Subject to any disclaimer, the term of this patent is extended or adjusted under 35 U.S.C. 154(b) by 199 days.

(21) Appl. No.: 13/996,875

(22) PCT Filed: Dec. 15, 2011

(86) PCT No.: PCT/EP2011/006322

§ 371 (c)(1),
(2), (4) Date: Aug. 30, 2013

(87) PCT Pub. No.: WO2012/084147

PCT Pub. Date: Jun. 28, 2012

(65) Prior Publication Data

US 2013/0326910 A1 Dec. 12, 2013

(30) Foreign Application Priority Data

Dec. 23, 2010 (DE) ..... 20 2010 016 915 U

(51) Int. Cl.
*A43B 7/06* (2006.01)
*A43B 7/08* (2006.01)
(Continued)

(52) U.S. Cl.
CPC ... *A43B 5/00* (2013.01); *A43B 5/02* (2013.01); *A43B 7/06* (2013.01); *A43B 11/00* (2013.01); *A43B 13/183* (2013.01); *A43B 17/06* (2013.01); *A43B 17/102* (2013.01)

(58) Field of Classification Search
CPC .... A43B 13/18; A43B 13/181; A43B 13/182; A43B 13/183; A43B 13/184; A43B 13/185; A43B 21/30; A43B 21/32; A43B 17/06
USPC ..... 36/1, 3 R, 3 B, 27, 38, 91, 100, 102, 158, 36/168
See application file for complete search history.

(56) References Cited

U.S. PATENT DOCUMENTS 324,065 A * 8/1885 Andrews ..... 36/37
569,589 A * 10/1896 Shaw ..... 36/37
(Continued)

FOREIGN PATENT DOCUMENTS

CH 17016 A 3/1899
CN 2 057 319 U 5/1990
(Continued)

OTHER PUBLICATIONS

English machine translation of Weigand (DE 620963 C) via Espacenet.com.*
(Continued)

*Primary Examiner* — Alissa L Hoey
*Assistant Examiner* — Jameson Collier
(74) *Attorney, Agent, or Firm* — Lucas & Mercanti, LLP

(57) ABSTRACT

The shoe includes a shoe upper and a sole connected to the shoe upper. The sole includes an upper sole element, and a lower sole element. The shoe also includes an elongated spring element attached at both ends to the shoe upper, or attached at one to the shoe upper and the other end to the upper side element. The elongated spring element exerts a force on the upper sole element to pull the upper sole element away from the lower sole element. The upper sole element has a surface on which the sole of a foot of a wearer of the shoe rests during use of the shoe. The upper sole element rests on the lower sole element during use of the shoe due to the weight of the wearer of the shoe. The elongated spring element pulls at least a part of the upper sole element away from the lower sole element to separate the part of the upper sole element from the lower sole element, during non-use of the shoe. The elongated spring element can be a rubber band.

12 Claims, 6 Drawing Sheets

Figure 1:
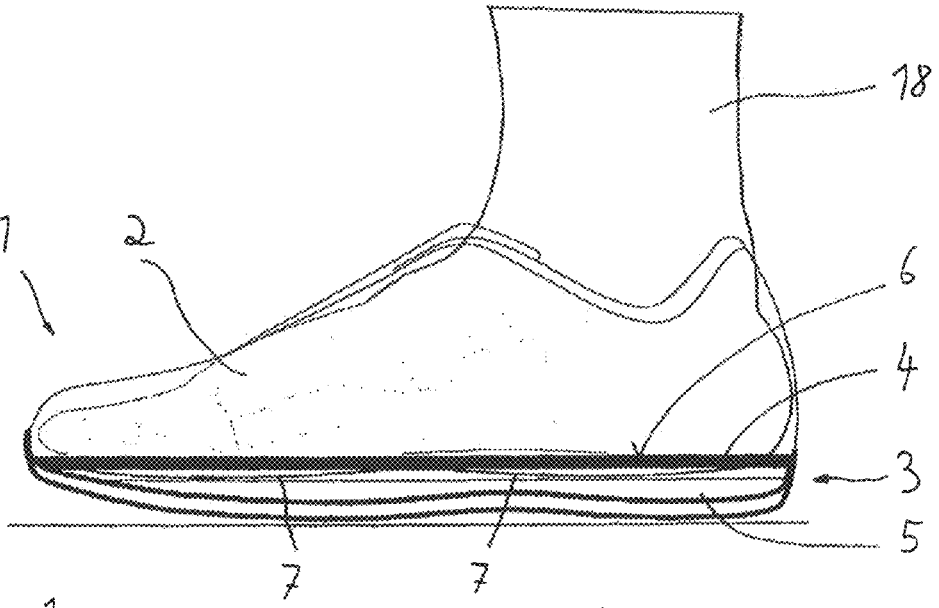

(51) Int. Cl.

| | |
|---|---|
| ***A43B 17/08*** | (2006.01) |
| ***A43B 5/00*** | (2006.01) |
| ***A43B 5/02*** | (2006.01) |
| ***A43B 11/00*** | (2006.01) |
| ***A43B 13/18*** | (2006.01) |
| ***A43B 17/06*** | (2006.01) |
| ***A43B 17/10*** | (2006.01) |

(56) References Cited

U.S. PATENT DOCUMENTS

| | | | | | |
|---|---|---|---|---|---|
| 673,869 | A | * | 5/1901 | Hampel et al. | 36/3 B |
| 733,167 | A | * | 7/1903 | Denton | 36/3 B |
| 900,920 | A | * | 10/1908 | Foster | 36/37 |
| 1,077,871 | A | * | 11/1913 | Connell | 36/158 |
| 1,194,152 | A | * | 8/1916 | Douglas | 36/28 |
| 1,623,092 | A | * | 4/1927 | Carr | 36/3 B |
| 2,413,545 | A | * | 12/1946 | Cordi | 36/1 |
| 2,552,711 | A | * | 5/1951 | Dunker | 36/3 R |
| 4,638,575 | A | * | 1/1987 | Illustrato | 36/38 |
| 4,760,651 | A | * | 8/1988 | Pon-Tzu | 36/3 B |
| 4,924,605 | A | * | 5/1990 | Spademan | A43B 5/00 36/114 |
| 5,010,661 | A | * | 4/1991 | Chu | 36/3 B |
| 5,311,678 | A | * | 5/1994 | Spademan | A43B 5/00 36/114 |
| 5,517,769 | A | * | 5/1996 | Zhao | 36/27 |
| 6,029,376 | A | * | 2/2000 | Cass | A43C 1/04 36/50.1 |
| 6,131,309 | A | | 10/2000 | Walsh | |
| 2004/0237348 | A1 | * | 12/2004 | Lacey | A43B 3/08 36/54 |
| 2005/0039348 | A1 | * | 2/2005 | Raluy | A43B 3/12 36/50.1 |
| 2006/0021262 | A1 | * | 2/2006 | Killion | A43B 7/38 36/136 |
| 2006/0174515 | A1 | * | 8/2006 | Wilkinson | A43B 11/00 36/27 |
| 2007/0271818 | A1 | * | 11/2007 | Rabushka | 36/38 |
| 2008/0189986 | A1 | * | 8/2008 | Elnekaveh | 36/102 |
| 2008/0256830 | A1 | * | 10/2008 | Frederick | A43B 13/183 36/91 |
| 2008/0263899 | A1 | * | 10/2008 | Lee | A43B 1/0045 36/102 |

FOREIGN PATENT DOCUMENTS

| | | | | |
|---|---|---|---|---|
| DE | 327846 | C | | 10/1920 |
| DE | 620 963 | C | | 10/1935 |
| FR | 484891 | A | * | 11/1917 |
| FR | 1227420 | A | * | 8/1960 |
| FR | 2080317 | A5 | * | 11/1971 |
| GB | 421322 | A | * | 12/1934 |
| GB | 2 041 721 | A | | 9/1980 |

OTHER PUBLICATIONS

English machine translation of Porhiel (FR 1227420 A) via Espacenet.com.*

* cited by examiner

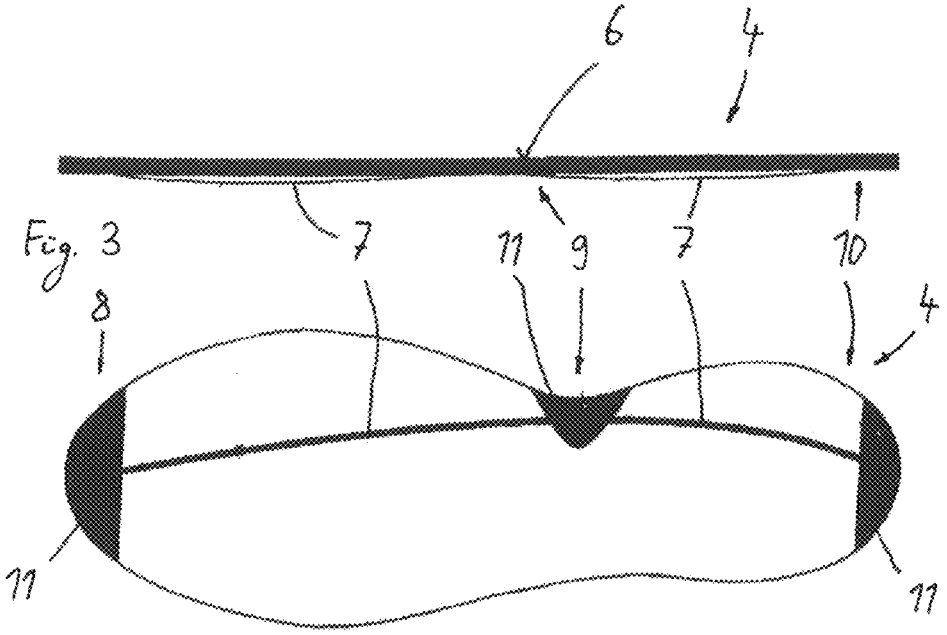
Fig. 3
Fig. 4
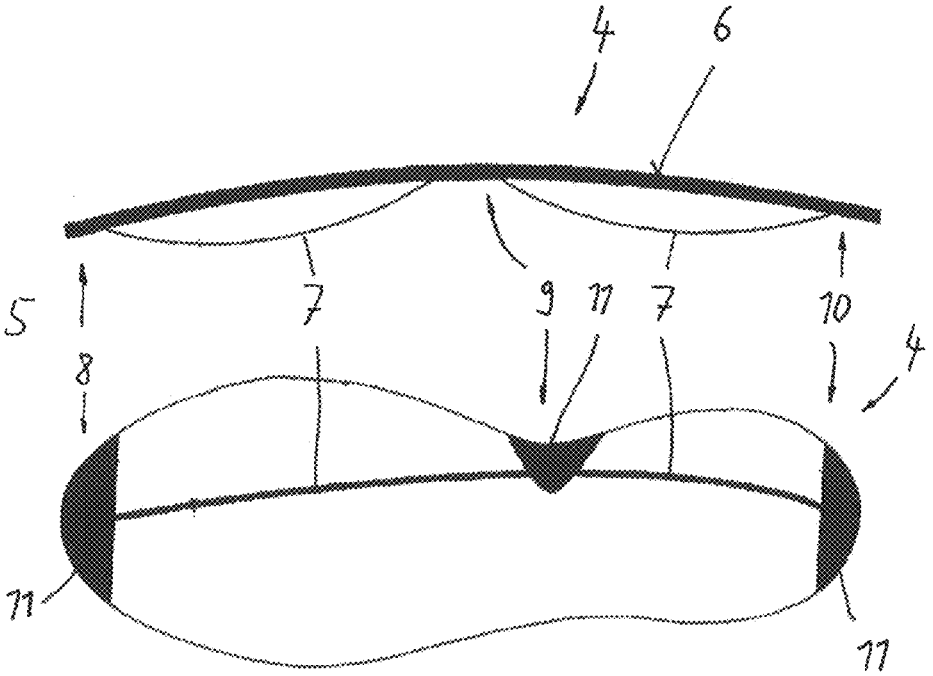
Fig. 5
Fig. 6

SHOE, IN PARTICULAR A SPORTS SHOE

CROSS-REFERENCE TO RELATED APPLICATIONS

This application is a 371 of PCT/EP2011/006322 filed Dec. 15, 2011, which in turn claims the priority of DE 20 2010 016 915.1 filed Dec. 23, 2010, the priority of both applications is hereby claimed and both applications are incorporated by reference herein.

The invention relates to a shoe, especially to a sport shoe, comprising a shoe upper and a sole which is connected with the shoe upper, wherein the sole comprises an upper sole element as well as a lower sole element, wherein the upper sole element has a surface on which the sole of foot of the wearer of the shoe rests during intended use of the shoe, wherein between the upper sole element and the lower sole element at least one spring element is effectively arranged, which spring element is designed and arranged in such a manner that the upper sole element rests on the lower sole element due to the weight of the wearer of the shoe, and that at least a part of the upper sole element lifts from the lower sole element due to the force of the spring element during non-use of the shoe.

Shoes of the generic kind are generally known and are for example used as soccer shoes. Especially—but not exclusively—during playing soccer it is often the case that humidity gets in the shoe, wherein water can reach especially the region between the insole and the inner sole and midsole respectively. Specifically in the case of soccer shoes, which mostly become frequently clammy and wet respectively, thus the danger exists that germinal and fungi respectively is generated between the bottom of the shoe (i.e. the inner sole) and the insole, because no sufficient ventilation is given.

A shoe of the above mentioned kind is known from DE 620 963 C. Comparable concepts are disclosed in U.S. Pat. No. 1,623,092 A, in GB 2 041 721 A, in CN 2 057 319 U and in U.S. Pat. No. 6,131,309 A.

It is the object of the invention to further develop a shoe of the generic kind so that the dehydration of the shoe can take place in an improved manner with simple means. By doing so it is aimed for that germinal and fungi respectively cannot be created so easy anymore. Thus, it is aimed for an improved dehydration effect which can be reached with low economical investment.

The solution of this object by the invention is characterized in that the spring element is designed as a strip from elastic material, wherein the strip from elastic material is fixed with one of its ends at the shoe upper and with its other end at the upper sole element or wherein the strip from elastic material is fixed with its ends at the shoe upper and encompasses the upper sole element.

Thus, the proposed spring element causes that an opening for supply of fresh air is created between the lower sole element and the upper sole element after taking off of the shoe which opening significantly promotes the dehydration process.

The upper sole element is preferably an insole. The lower sole element is preferably a midsole, wherein an outer sole is arranged at its bottom side; it can also be an inner sole.

The spring element can be designed a rubber band. Thereby, the strip from elastic material can be fixed with one of its ends at the shoe upper, preferably at a height position in the upper half of the vertical extension of the shoe at that location where the strip is arranged. The strip from elastic material can be fixed with its other end at the upper sole element. But it is also possible that the strip from elastic material is fixed with its ends at the shoe upper and encompasses the upper sole element. The strip from elastic material is preferably arranged in the heel region of the upper sole element.

The upper sole element can be pivoted in the shoe around a horizontal swivel axis which lies in its toe region.

Preferably, the upper sole element lifts from at least 90% of the contact area during non-use of the shoe, which contact area is given between upper sole element and lower sole element during intended use of the shoe.

But it can also be provided that only a part of the upper sole element lifts from the lower sole element during non-use of the shoe. Thereby, only a lamellar section of the upper sole element can lift from the lower sole element during non-use of the shoe. Thereby, the lamellar section can have a substantial rectangular shape in the top plan view of the shoe. It can have a width which is between 40% and 80% of the width of the shoe in its heel region. Furthermore, it can be provided that the lamellar section has a length which is between 50% and 90% of the length of the shoe.

The proposed shoe is specifically preferred a soccer shoe.

To obtain an improved dehydration effect the idea according to the invention thus provides that especially the insole is biased with a spring element in such a manner that the insole lifts off automatically after taking off the shoe and so the region between the insole and the inner sole is exposed at least partially. Existing clamminess in this region can evaporate in a better manner. I.e. the insole can arch upwards due to the spring element. If applicable this effect can also be limited to a part of the insole only (i.e. only to a section of the insole, e.g. to a tongue-shaped section which lifts and arch upwards respectively during taking off the shoe). Beneficially, the dehydration of the bottom side of the insole as well as of the bottom of the leg of the shoe takes place in a substantial more simple manner.

Figure 2:
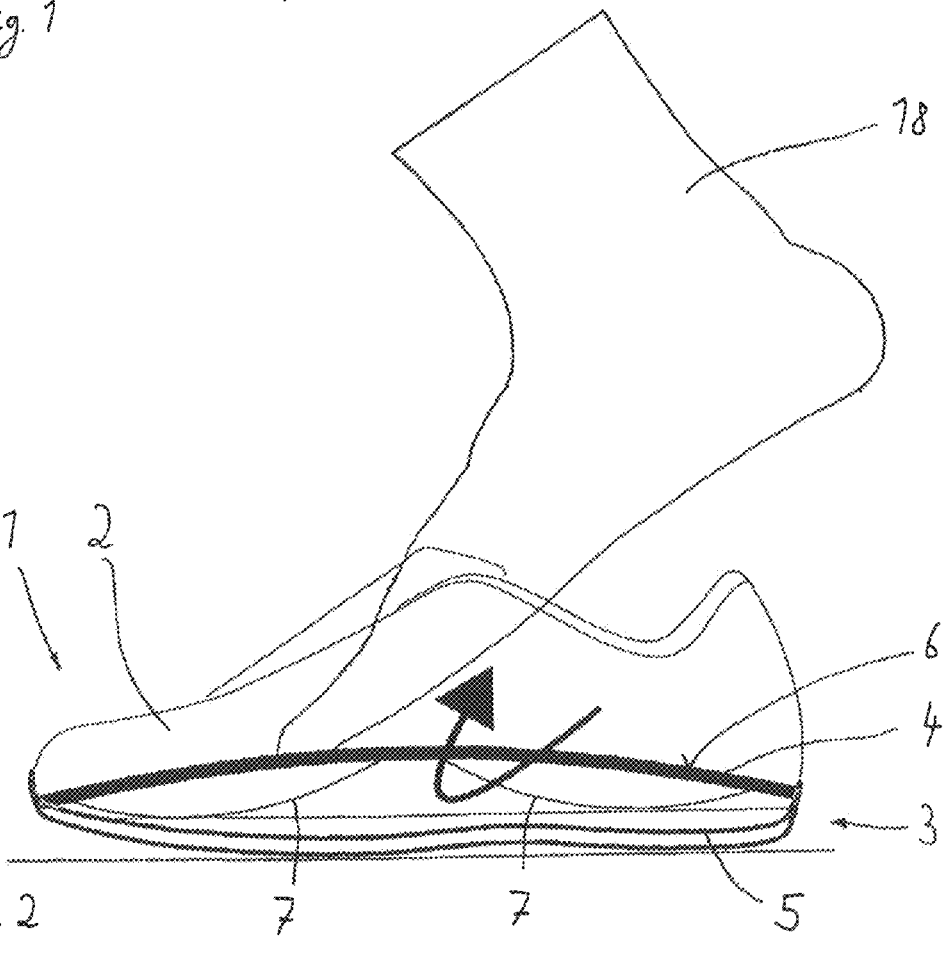
Figure 7:
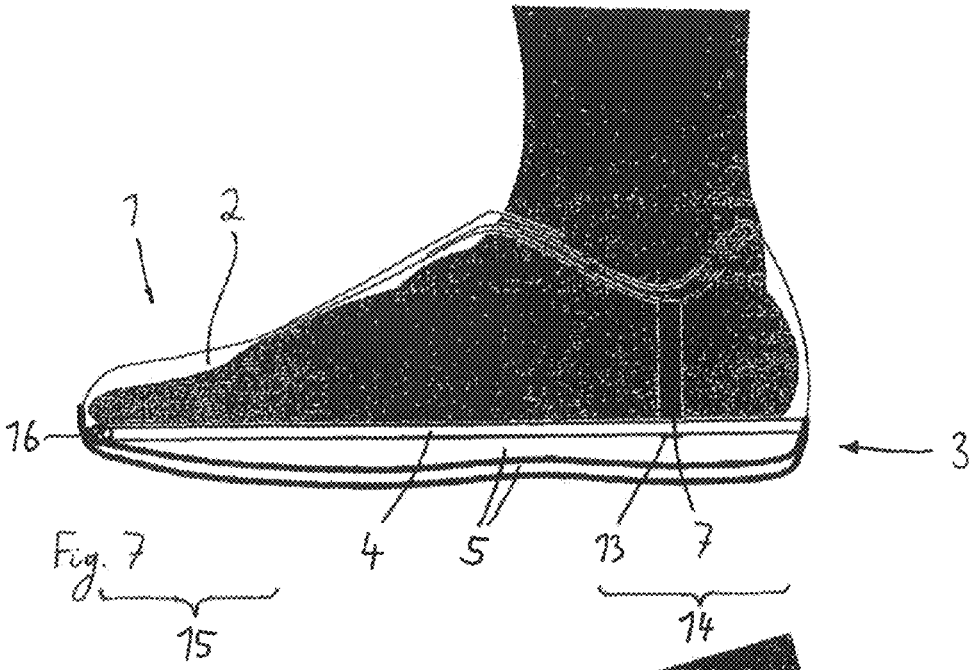
Figure 8:
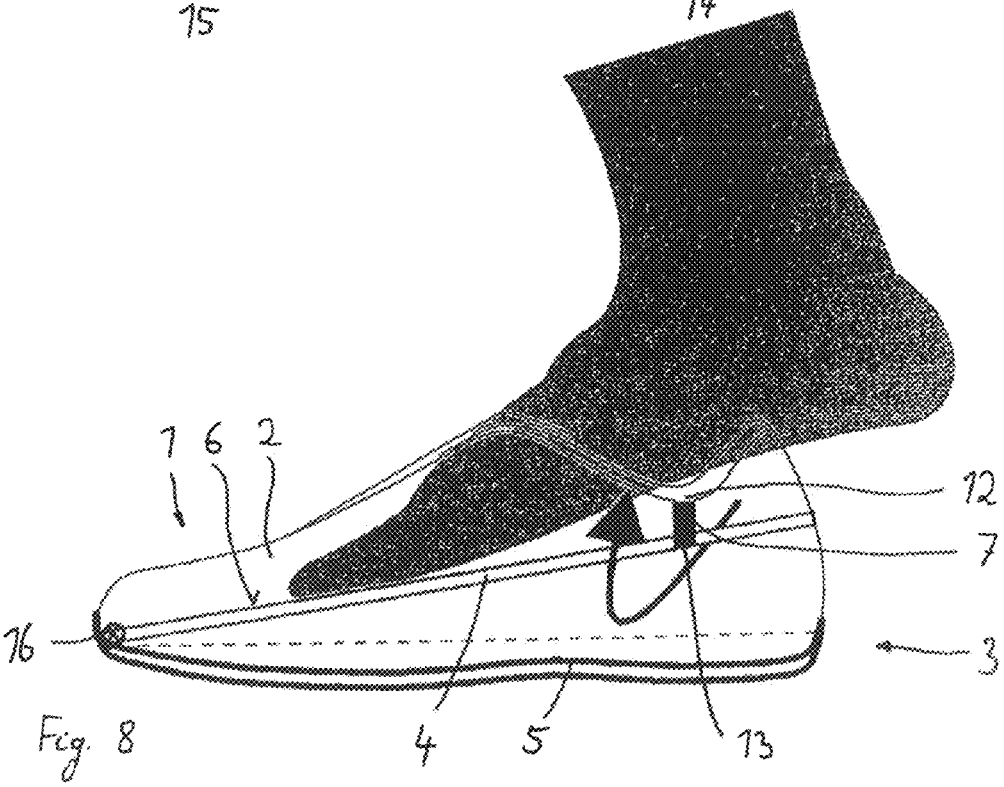
Figure 9:
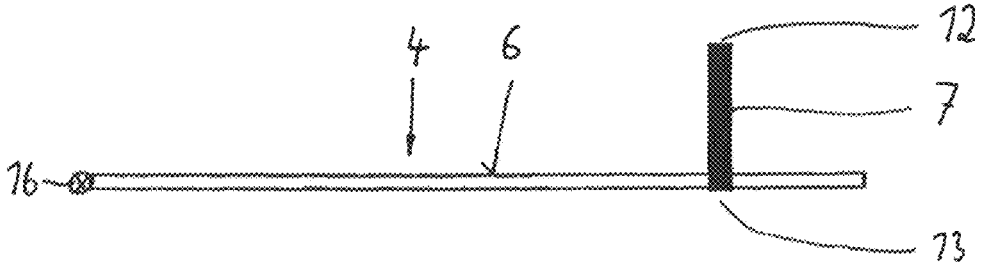
Figure 10:
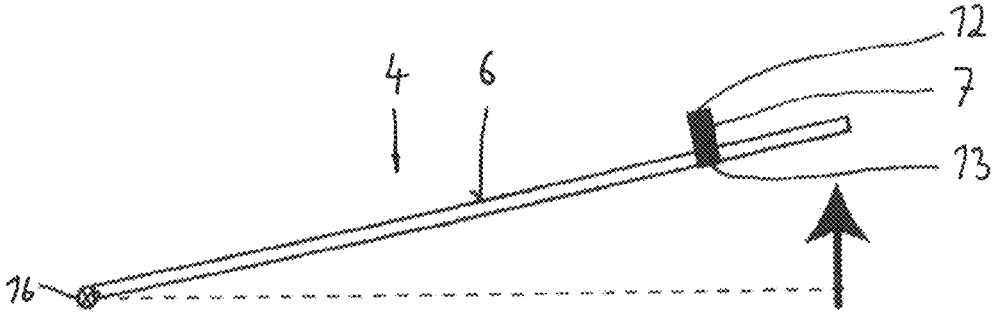
Figure 11:
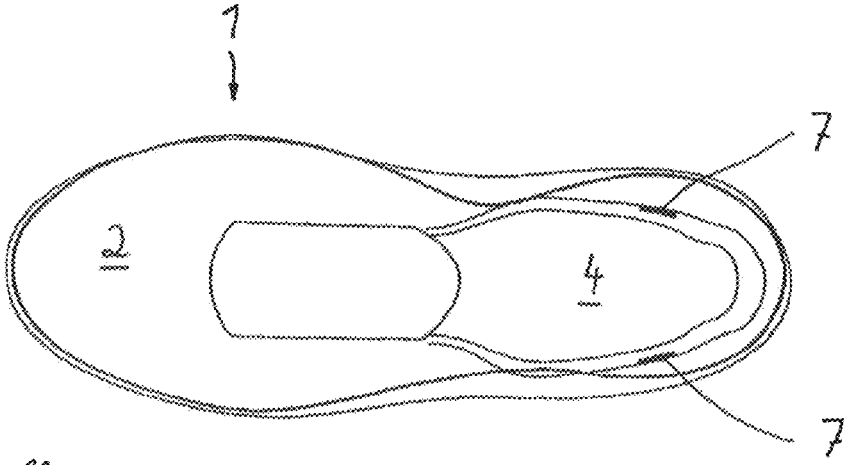
Figure 12:
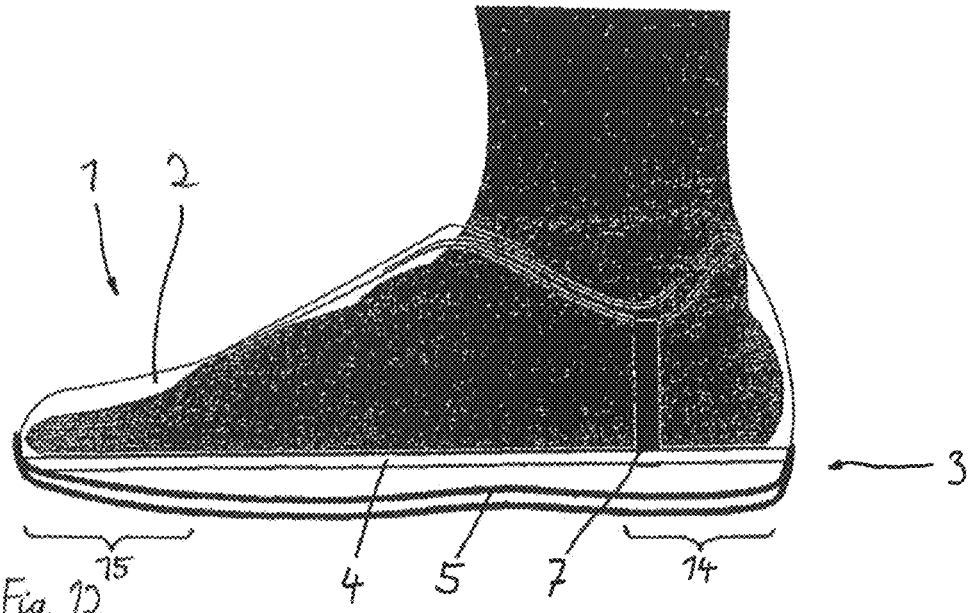
Figure 13:
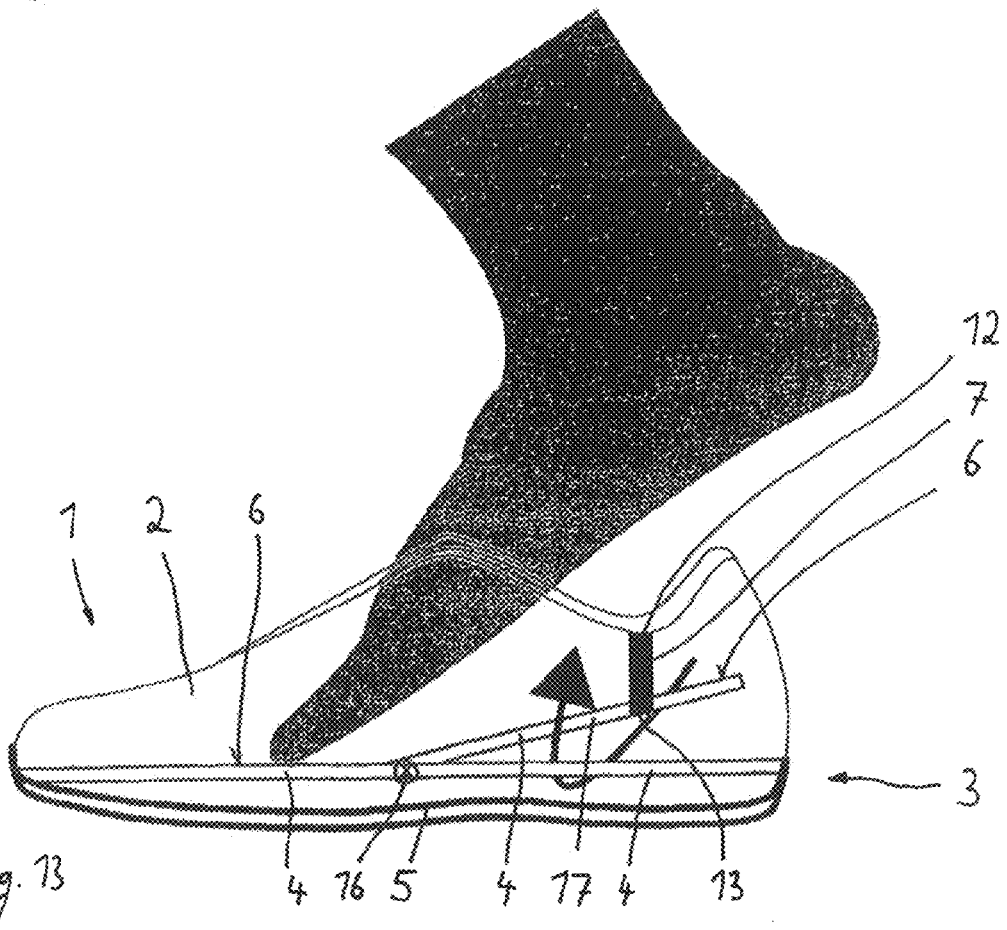
Figure 14:
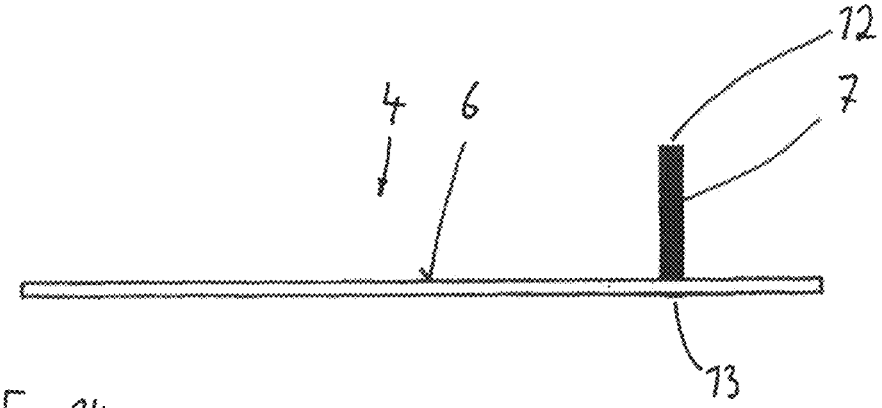
Figure 15:
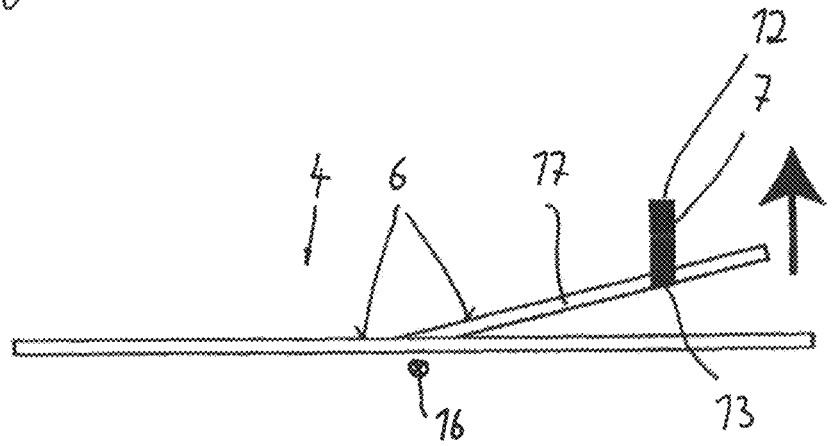
Figure 16:
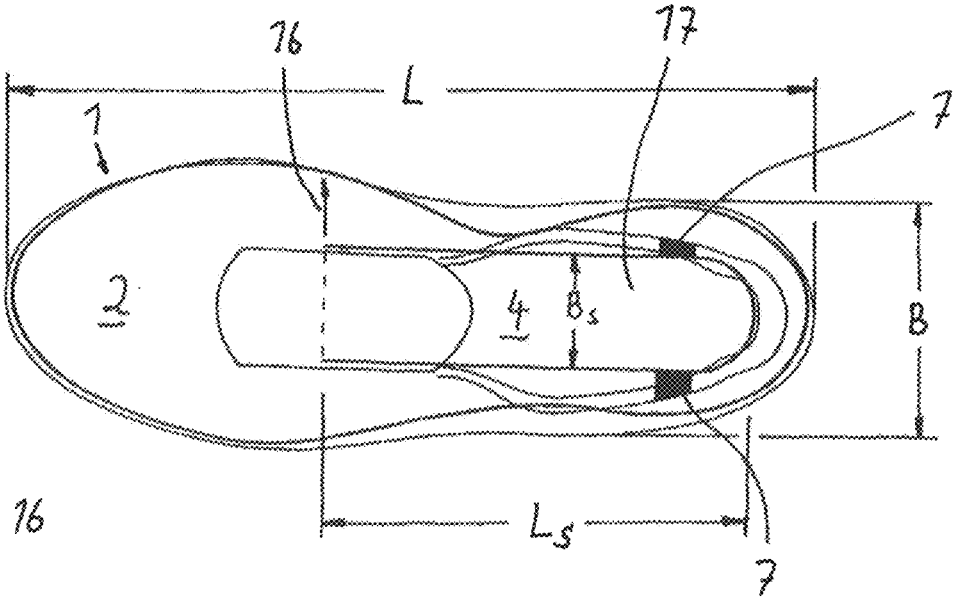

In the drawing embodiments of the invention are illustrated. It shows:

FIG. 1 the sectional side view of a sport shoe which is used by a wearer according to a first embodiment of the invention, FIG. 2 the sectional side view of a sport shoe according to FIG. 1, wherein the wearer of the shoe just takes it off, FIG. 3 the side view of the insole of the shoe according to FIGS. 1 and 2, wherein the insole is shown in a position in which it is loaded by the weight of the wearer of the shoe, FIG. 4 the top plan view of the insole according to FIG. 3, FIG. 5 the side view of the insole of the shoe according to FIGS. 1 and 2, wherein the insole is now shown in a position in which it is released from the weight of the wearer, FIG. 6 the top plan view of the insole according to FIG. 5, FIG. 7 the sectional side view of the sport shoe which is used by a wearer according to a second embodiment of the invention, FIG. 8 the sectional side view of the sport shoe according to FIG. 7, wherein the wearer of the shoe just takes it off, FIG. 9 the side view of the insole of the shoe according to FIGS. 7 and 8, wherein the insole is shown in a position in which it is loaded by the weight of the wearer of the shoe, FIG. 10 the side view of the insole of the shoe according to FIGS. 7 and 8, wherein the insole is now shown in a position in which it is released from the weight of the wearer, FIG. 11 the top plan view of the shoe according to FIGS. 7 and 8, FIG. 12 the sectional side view of the sport shoe which is used by a wearer according to a third embodiment of the invention, FIG. 13 the sectional side view of the sport shoe according to FIG. 12, wherein the wearer of the shoe just takes it off, FIG. 14 the side view of the insole of the shoe according to FIGS. 12 and 13, wherein the insole is shown in a position in which it is loaded by the weight of the wearer of the shoe, FIG. 15 the side view of the insole of the shoe according to FIGS. 12 and 13, wherein the insole is now shown in a position in which it is released from the weight of the wearer and FIG. 16 the top plan view of the shoe according to FIGS. 12 and 13.

In FIG. 1 a shoe 1 can be seen which is worn by a wearer; the foot of the wearer is denoted with 18. The shoe 1 has a shoe upper 2 and a sole 3 which is fixed at the bottom of the shoe upper 2. The sole consists of an upper sole element 4 in the form of an insole and of a lower sole element 5 which is generally the sole part without insole, i.e. especially a midsole, wherein an outer sole is arranged at the bottom side of the insole.

The insole, i.e. the upper sole element 4, has a surface 6 on which the foot 18 of the wearer lies during the use of the shoe 1.

When the shoe 1 is worn the insole 4 is firmly pressed against the lower sole element 5 due to the weight force of the wearer so that the situation occurs as depicted in FIG. 1.

Between the upper sole element 4 and the bottom sole element 5 a spring element 7 in the form of a spring wire clip is effectively arranged. Thereby, the spring element 7 is so designed and positioned that the upper sole element 4 lies on the lower sole element 5 due to the weight force of the wearer of the shoe 1—thus during wearing of the shoe (see FIG. 1); however, when the shoe is not used—see FIG. 2—the upper sole element 4 lifts off along the major part of the contact area which is given between the upper and lower sole part during the use of the shoe. The upper sole element 4 is namely arched upwards by the spring element 7 as can be seen in FIG. 2, so that air can enter into the region between the upper and the lower sole part so that clamminess in this region can better evaporate. The entry of air which is now improved is denoted by the arrow in FIG. 2.

Therefore, the spring element 7 is connected with the insole 4 at three junctions 8, 9 and 10 as can be seen in FIG. 3 to 6, wherein holding elements 11 hold the wire-shaped spring element 7 at the bottom side of the insole 4 in the three junctions 8, 9 and 10. Thus, while the insole 4 can be hold flat during use as can be seen in FIG. 3 so that it completely lies on the bottom sole element 5, it arch upwards when the shoe is not used as can be seen from FIG. 6.

The spring element 7 comprises two arcs in the embodiment (see FIG. 5); it can also be only one arc; however, also more than two arcs are possible.

In FIG. 7 to 11 an alternative of the proposed shoe can be seen. The insole 4 is biasly arranged by two spring element 7 in form of rubber bands in the heel region 14 of the shoe (see FIG. 7). More specifically, at each side of the shoe (see for this FIG. 11) one rubber band 7 is fixed, namely with one end 12 at the shoe upper 2 and with the other end 13 at the insole 4. In the toe region 15 of the shoe the insole 4 is so arranged in the shoe that the insole 4 can pivot around a horizontal swivel axis 16 (denoted is an arrow direction extending perpendicular on the plane of projection which marks the swivel axis). The pivot movement is apparent from the synopsis of FIGS. 9 and 10.

Thus, when the shoe 1 is taken off (see FIG. 8) the insole 4 pivots around the swivel axis 16 due to the spring force of the two spring elements 7 from the position according to FIG. 7 and FIG. 9 respectively into the position according to FIG. 8 and FIG. 10 respectively. Accordingly, the air is allowed again (see arrow in FIG. 8) to enter into the region between the sole elements 4 and 5 and to promote the dehydration.

Also, only one single spring element 7 in form of a rubber band can be provided which ends are fixed at the shoe upper 2 and which encompassed the insole 4 to pull upward the insole during non-use by the foot of the wearer into the position as shown in FIG. 8.

A further alternative of the proposed shoe is shown in FIG. 12 to 16.

Here, the difference to the solution according to FIG. 7 to 11 is that not the whole insole 4 is liftable arranged by means of the spring element 7, but that this applies only for a part of the insole 4, namely for a lamellar section 17.

The lamellar section 17 extends along a width $B_S$ which corresponds to a part of the width B of the shoe 1 in its heel region 14, e.g. between 40% and 80% of the width B. Furthermore, the section 17 has a length $L_S$ which corresponds to a part of the length L of the shoe 1, e.g. between 50% and 90% of the length L.

For the arrangement of the one spring element 7 or of the two spring elements 7 (one on each side of the section 17) applies the same as described in connection with the embodiment according to FIG. 7 to 11.

LIST OF REFERENCES

1 Shoe
2 Shoe upper
3 Sole
4 Upper sole element (insole)
5 Lower sole element (midsole and outer sole)
6 Surface
7 Spring element
8 Junction
9 Junction
10 Junction
11 Holding element
12 End of spring element
13 End of spring element
14 Heel region
15 Toe region
16 Swivel axis
17 Lamellar section
18 Foot
$B_S$ Width of the lamellar section
B Width of the shoe in the heel region
$L_S$ Length of the lamellar section
L Length of the shoe

The invention claimed is:

1. A shoe comprising:

a shoe upper; and a sole connected to the shoe upper, wherein the sole comprises:

an upper sole element;

a lower sole element; and a rubber band, the rubber band being adapted to exert on the upper sole element a force that pulls at least a part of the upper sole element away from the lower sole element;

wherein the upper sole element has a surface on which the sole of a foot of a wearer of the shoe rests during use of the shoe, wherein the upper sole element rests on the lower sole element during use of the shoe due to a weight of the wearer of the shoe, and wherein the rubber band pulls at least the part of the upper sole element away from the lower sole element, thereby separating at least the part of the upper sole element from the lower sole element, during non-use of the shoe, wherein the rubber band has a first end and a second end, and the first end and the second end of the rubber band are fixed directly to the shoe upper and a section of the rubber band between the first end and the second end passes under the upper sole element and above the lower sole element.

2. The shoe according to claim 1, wherein the upper sole element comprises an insole.

3. The shoe according to claim 1, wherein the lower sole element comprises a midsole, wherein an outer sole is arranged at a bottom side of the midsole.

4. The shoe according to claim 1, wherein the rubber band is disposed in a heel region of the upper sole element.

5. The shoe according to claim 4, wherein the upper sole element is adapted to pivot around a horizontal swivel axis located in a toe region of the shoe.

6. The shoe according to claim 1, wherein contact between the upper sole element and the lower sole element occurs in a contact area during use of the shoe, wherein the upper sole element separates from at least 90% of the contact area during non-use of the shoe.

7. The shoe according to claim 1, wherein only the part of the upper sole element separates from the lower sole element during non-use of the shoe.

8. The shoe according to claim 7, wherein the part of the upper sole element that separates from the lower sole element during non-use of the shoe is a lamellar section.

9. The shoe according to claim 8, wherein the lamellar section has a rectangular shape from a top plan view.

10. The shoe according to claim 9, wherein the lamellar section has a first width that is between 40% and 80% of a second width of a heel region of the shoe.

11. The shoe according to claim 9, wherein the lamellar section has a first length that is between 50% and 90% of a second length of the shoe.

12. The shoe according to claim 1, wherein the shoe is a soccer shoe.

* * * * *